US011840948B2

(12) United States Patent
Müller et al.

(10) Patent No.: US 11,840,948 B2
(45) Date of Patent: Dec. 12, 2023

(54) SILENCER FOR AN EXHAUST SYSTEM OF AN INTERNAL COMBUSTION ENGINE

(71) Applicant: Purem GmbH, Neunkirchen (DE)

(72) Inventors: Thomas Müller, Breitenbach (DE); Philipp Kratz, St. Ingbert (DE); Benjamin Röhr, Esslingen (DE); Thomas Uhlemann, Esslingen (DE); Nicolas Mettenleiter, Köngen (DE); Frank Berkemer, Eningen (DE)

(73) Assignee: Purem GmbH, Neunkirchen (DE)

( * ) Notice: Subject to any disclaimer, the term of this patent is extended or adjusted under 35 U.S.C. 154(b) by 0 days.

(21) Appl. No.: 17/841,192

(22) Filed: Jun. 15, 2022

(65) Prior Publication Data

US 2022/0397050 A1 Dec. 15, 2022

(30) Foreign Application Priority Data

Jun. 15, 2021 (DE) ..... 10 2021 115 392.1

(51) Int. Cl.
*F01N 13/18* (2010.01)

(52) U.S. Cl.
CPC ..... *F01N 13/1888* (2013.01); *F01N 13/1844* (2013.01)

(58) Field of Classification Search
CPC ..... F01N 13/1888; F01N 13/1894; F01N 2470/18
See application file for complete search history.

(56) References Cited

U.S. PATENT DOCUMENTS 6,158,214 A * 12/2000 Kempka ..... F01N 1/023 181/227
2013/0153329 A1 6/2013 Bischel et al.
2014/0116801 A1* 5/2014 Andre ..... F01N 1/08 181/213
2016/0245140 A1* 8/2016 Boriga ..... F01N 3/038
2019/0120115 A1* 4/2019 Zdravkov ..... F01N 13/185
2019/0234264 A1 8/2019 Okami

FOREIGN PATENT DOCUMENTS

DE 10 2011 077 183 A1 12/2012
DE 10 2012 206 871 A1 10/2013
DE 10 2015 102 611 A1 8/2016
DE 10 2019 101 298 A1 8/2019

* cited by examiner

*Primary Examiner* — Jonathan R Matthias
(74) *Attorney, Agent, or Firm* — Walter Ottesen, P.A.

(57) ABSTRACT

A silencer for an exhaust gas system of an internal combustion engine includes a silencer housing which surrounds a silencer interior and which has at least two housing portions which are adjacent to each other in an abutment region. The two housing portions are connected to each other. The silencer housing has at least one housing opening formed therein and an outlet pipe extends through the silencer housing in the region of the housing opening. The housing opening is completely formed in one of the two housing portions.

10 Claims, 2 Drawing Sheets

SILENCER FOR AN EXHAUST SYSTEM OF AN INTERNAL COMBUSTION ENGINE

CROSS REFERENCE TO RELATED APPLICATION

This application claims priority of German patent application no. 10 2021 115 392.1, filed Jun. 15, 2021, the entire content of which is incorporated herein by reference.

TECHNICAL FIELD

The present disclosure relates to a silencer for an exhaust gas system of an internal combustion engine.

SUMMARY

It is an object of the disclosure to provide a silencer which is simple and cost-effective to produce with little waste during production and which is nonetheless reliable in operation.

According to the disclosure, this object can, for example, be achieved via a silencer for an exhaust gas system of an internal combustion engine, including a silencer housing which surrounds a silencer interior and which has at least two housing portions which are adjacent to each other in an abutment region and which are connected to each other and at least one outlet pipe which extends through the silencer housing in the region of a housing opening which is formed in the silencer housing, wherein at least one housing opening through which an outlet pipe extends is completely formed in one of the housing portions.

Since, with the silencer which is constructed according to the disclosure, at least in connection with one, preferably in connection with each outlet pipe there is provision for this pipe to extend through the silencer housing in a region in which two housing portions of the silencer do not adjoin each other, the connection of such an outlet pipe to the silencer housing can be produced as a two-part connection, in the region of which only this outlet pipe and the housing portion of the silencer housing are connected to each other in order to provide a gas-tight closure which completely provides the housing opening through which the outlet pipe extends. This operation can be carried out in a significantly easier manner, with greater reliability and less waste than a connection operation in which three or four components of a silencer or an exhaust gas system are intended to be connected to each other. At the same time, the configuration according to the disclosure of a silencer enables an outlet pipe to be positioned with a greater degree of freedom, which also enables the structural configuration inside the silencer, particularly with regard to an easier and consequently also more cost-effective, space-saving construction and the reduction of the pollutant emission with a greater degree of freedom.

The silencer housing may, for example, include two housing shells which each provide a housing portion and which are each connected to each other in the abutment region by means of material engagement and/or positive-locking engagement. At least one housing opening which is completely formed in one of the housing portions may in this instance be formed in one of the housing shells.

A compact construction in particular in a longitudinal direction of a silencer can be achieved by the silencer housing having a circumferential wall which is elongate in the direction of a longitudinal housing axis and at both axial end regions of the circumferential wall an end wall and by at least one housing opening which is completely formed in one of the housing portions being formed in the circumferential wall. If the silencer housing is constructed with two housing shells, each of the housing shells may provide a portion of the two end walls and a portion of the circumferential wall in each case.

For accommodation below the underbody of a vehicle, it may be advantageous for the silencer housing to be flattened orthogonally with respect to the longitudinal housing axis and for at least one housing opening which is completely formed in one of the housing portions to be formed in a region of the circumferential wall which provides a wide side of the silencer housing. During installation in a vehicle this wide side may be orientated in a downward direction so that, when such a silencer forms an end silencer, exhaust gas which is discharged from an outlet pipe is expelled in a downward direction.

For an assembly which is easy to carry out, at least one housing opening which is completely formed in one of the housing portions may be formed in a substantially non-curved region of the circumferential wall.

A compact construction type can be supported in that, with at least one outlet pipe which extends through the silencer housing in the region of a housing opening which is completely formed in one of the housing portions, a longitudinal center axis of this outlet pipe is angled in the region of the longitudinal region thereof which extends through the housing opening with respect to an opening center axis.

To this end, there may further be provision for at least one outlet pipe which extends through the silencer housing in the region of a housing opening which is completely formed in one of the housing portions not to protrude over the silencer housing in the direction of the longitudinal housing axis.

In order to prevent an abutment interaction between an outlet pipe and the silencer housing on a sharp-edged region of the silencer housing, it is proposed that in the region of at least one housing opening which is completely formed in one of the housing portions an edge region which surrounds this housing opening is shaped in a direction away from the silencer interior. The outlet pipe then does not abut an end of the silencer housing which is formed, for example, by means of punching, but instead against a surface region which is formed by means of shaping.

In order to be able to direct the exhaust gas flow leaving the silencer in a defined direction, an outlet pipe which extends through at least one housing opening which is completely formed in one of the housing portions may extend from the silencer interior beyond the edge region which surrounds this housing opening.

If a very compact shape of the silencer which protrudes over the outer circumference of a vehicle to the smallest possible extent is intended to be achieved, there may be provision for an outlet pipe which extends through at least one housing opening which is completely formed in one of the housing portions to terminate substantially flush with the edge region which surrounds this housing opening.

In order to achieve a simple-to-produce, gas-tight and mechanically stable connection between an outlet pipe and the silencer housing, an outlet pipe which extends through at least one housing opening which is completely formed in one of the housing portions can be connected to the silencer housing in the region of the edge region which surrounds this housing opening by means of welding.

In an embodiment, an outlet pipe which extends through at least one housing opening which is completely formed in one of the housing portions may be constructed integrally with the longitudinal region thereof which extends in the region of the housing opening and outside the silencer interior and may provide an exhaust gas outlet opening for discharging exhaust gas to the environment. This means that, particularly also in the region in which the outlet pipe extends through the silencer housing, two pipe portions do not have to be connected to each other in order to provide the outlet pipe and where applicable also to the silencer housing. An end pipe which is generally available and which provides an additional component which is intended to be connected to the outlet pipe which guides exhaust gas out of the silencer interior and which leads through the silencer housing is therefore not necessary in the construction according to the disclosure. This also has a particularly advantageous effect on the weight and the volume of a silencer or an exhaust gas system which is constructed therewith and enables the structural space which is available to be used in an efficient manner in particular also for the silencer with regard to the sound damping characteristic and the pollutant emission.

The disclosure further relates to an exhaust gas system for an internal combustion engine, including a silencer which is constructed according to the disclosure.

In an embodiment, the silencer is an end silencer and an exhaust gas outlet opening on an outlet pipe which extends through at least one housing opening which is completely formed in one of the housing portions is provided for discharging exhaust gas to the environment.

BRIEF DESCRIPTION OF THE DRAWINGS

The invention will now be described with reference to the drawings wherein.

DESCRIPTION OF THE PREFERRED EMBODIMENTS

Figure 1:
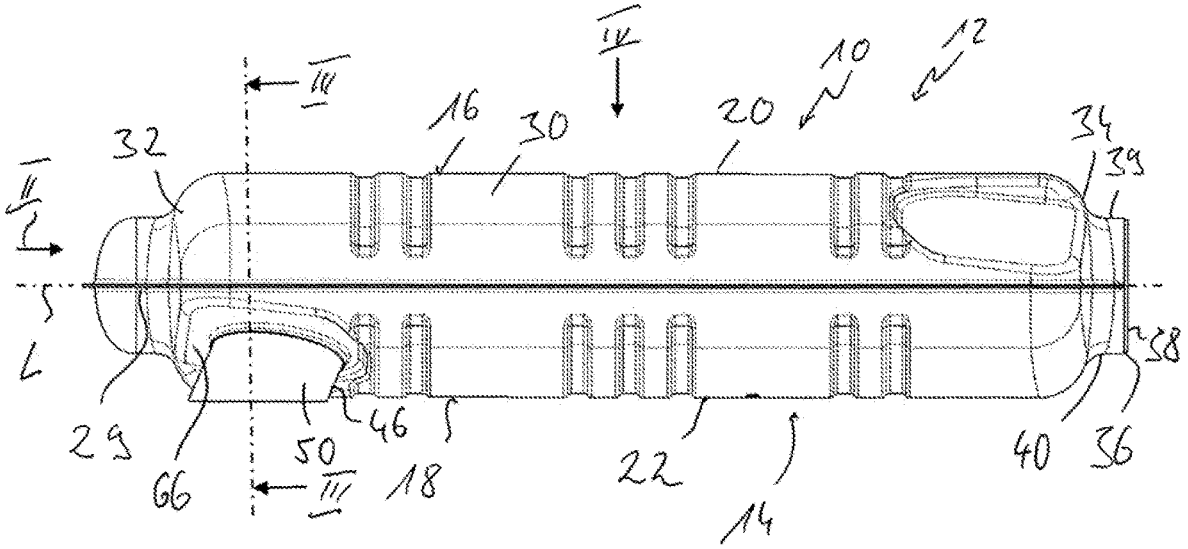
FIG. 1 shows a side view of a silencer in the viewing direction I in FIG. 2.

The silencer 10 shown in FIG. 1 may provide an end silencer of an exhaust gas system which is generally designated 12 of an internal combustion engine in a vehicle. The silencer 10 includes a silencer housing which is generally designated 14 and which in the embodiment shown is constructed with two housing shells 20, 22 which each provide a housing portion 16 and 18, respectively. The silencer 10 is constructed so that, also when installed in a vehicle, the housing shell 20 is an upper housing shell which is thus orientated upward in a vertical direction, and the housing shell 22 is a lower housing shell which is orientated downward in the vertical direction or which faces the ground.

Each of the two housing shells 20, 22 can preferably be provided as a molded sheet metal component and has a connection edge 26, 28 which is bent outward with respect to a silencer interior 24. The two connection edges 26, 28 provide an abutment region 29 of the housing shells 20, 22 in which they are in abutment with each other and, for example, connected to each other by welding. Alternatively or additionally, the two housing shells 20, 22 could be connected to each other in these edge regions 26, 28 by a positive-locking connection which is formed by beading.

The two housing shells 20, 22 provide on the silencer housing 14 a circumferential wall 30 which surrounds a longitudinal housing axis L, wherein each of the two housing shells 20, 22 provides substantially half of the circumferential wall 30. In the two axial end regions of the silencer housing 14, the two housing shells 20, 22 together provide an end wall 32, 34, wherein each of the two housing shells 20, 22 also provides approximately half of a respective end wall in this embodiment.

On the end wall 34 illustrated on the right in FIG. 1, there is formed a housing opening 36 through which an inlet pipe 38 extends. The housing opening 36 is positioned in such a manner that it is located substantially halfway in the two housing shells 20, 22 and consequently interrupts the connection edges 26, 28 which form the abutment region 29. In the region of the housing opening 36, there is formed on each of the housing shells 20, 22 an edge region 39, 40 which is shaped in the direction away from the silencer interior 24 and which substantially provides a cylindrical structure of the housing opening 36, and to which the inlet pipe 38 is connected in a secure and gas-tight manner, for example, by welding. In this embodiment, as indicated in FIG. 1, the inlet pipe 38 may protrude slightly in an outward direction over the silencer housing 14 in the region of the edge regions 39, 40 or may terminate flush with the two edge regions 39, 40. In the inlet pipe 38, an exhaust gas pipe of the exhaust gas system 12, which pipe guides exhaust gas from the region of an internal combustion engine to the silencer 10, is used and connected to the inlet pipe 38 and where applicable also the two housing shells 20, 22 of the silencer housing 14 in a secure and gas-tight manner by welding.

In the embodiment shown, the inlet pipe 38 extends through an intermediate wall 42 which is arranged in the silencer interior 24 and which is retained between the two housing shells 20, 22 and extends into a chamber 44 formed in the silencer interior 24. In the region of the chamber 44, an outlet pipe 46 adjoins the inlet pipe 38 and is connected to the inlet pipe 38 in a secure and gas-tight manner, for example, by welding and/or a press-fit connection. The outlet pipe 46 extends through a housing opening 48 which will be described in greater detail below in the lower housing shell 22 and extends with the longitudinal region 50 thereof which extends through the housing opening 48 slightly beyond the housing opening 48 from the silencer housing 14.

In the region of another chamber 52 which is separated from the chamber 44 via the intermediate wall 42, the inlet pipe 38 is open via a plurality of openings 54 to the silencer interior 24, in particular to the chamber 52.

Furthermore, in the longitudinal region of the inlet pipe 38 extending in the chamber 52 there branches therefrom a resonator pipe 56 which extends through an associated opening in the intermediate wall 42 and which consequently together with the chamber 44 provides a Helmholtz resonator.

It should be noted that the path of the inlet pipe 38 and of the outlet pipe 46 in the silencer interior 24 are illustrated only by way of example. There could be provided in the silencer interior 24 more than the two illustrated chambers 44, 52 which could communicate with each other by one or more pipes which extend exclusively in the silencer interior 24. For the purposes of the present disclosure, it is significant that there is provided at least one inlet pipe 38 via which exhaust gas is directed into the silencer interior 24, and there is provided at least one outlet pipe 46, via which exhaust gas leaves the silencer housing 14. The inlet pipe 38 and the outlet pipe 46 do not necessarily have to directly adjoin each other in this instance, but instead, for example, could also be open to one or different chambers and in this manner be in a connection with respect to each other which guides the exhaust gas through the silencer interior 14.

Figure 2:
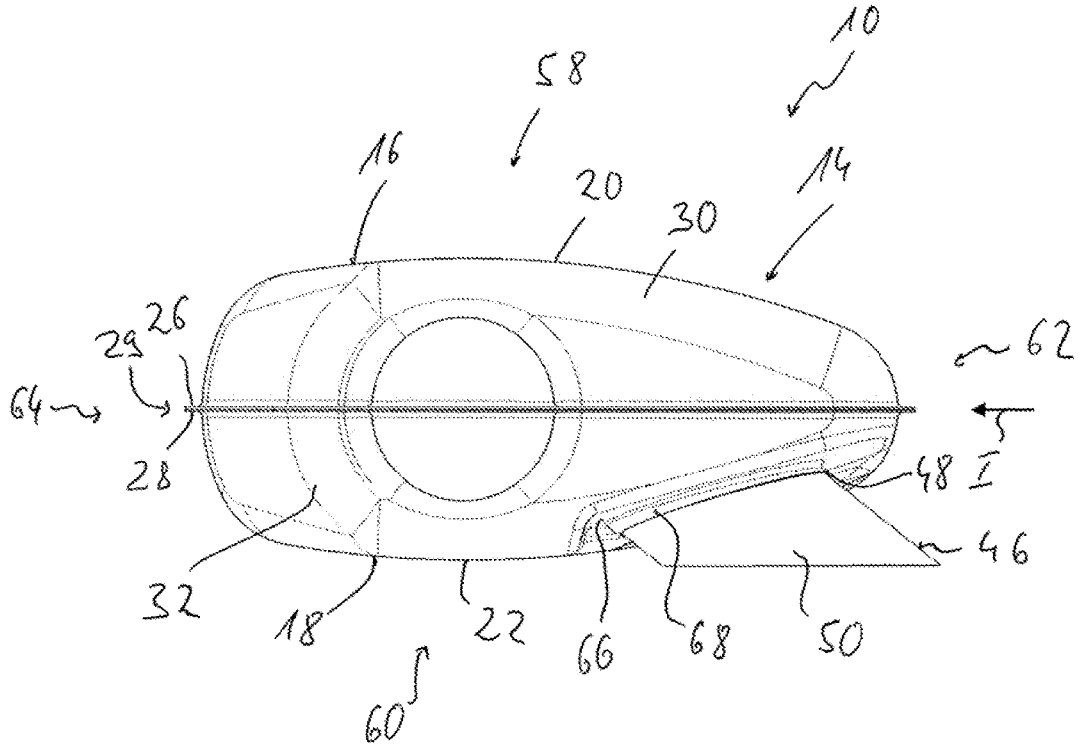
FIG. 2 shows an axial view of the silencer in FIG. 1 in the viewing direction II in FIG. 1.
Figure 3:
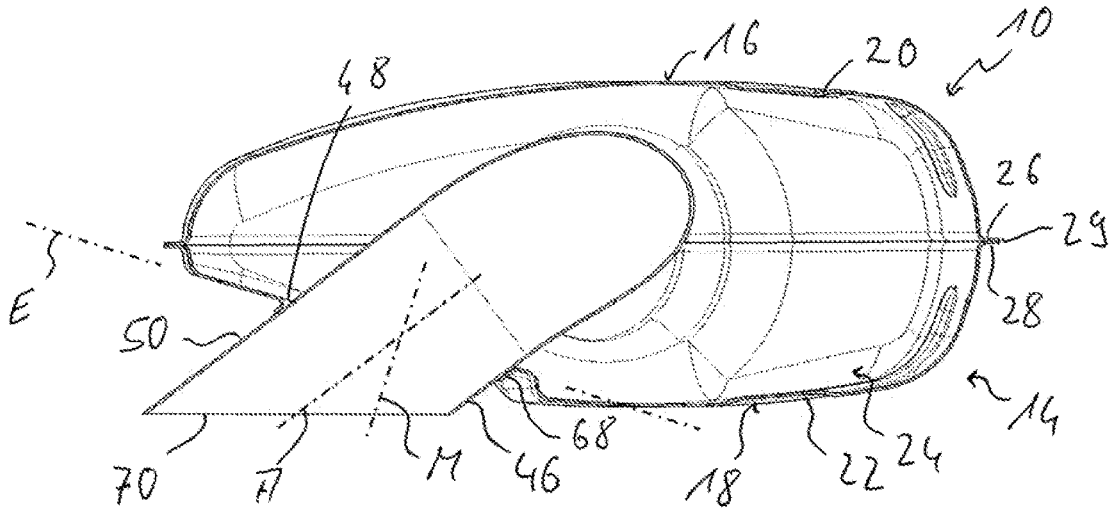
FIG. 3 shows a cross section of the silencer from FIG. 1, in a state sectioned along a line III-III in FIG. 1; and, FIG. 4 shows a plan view of the silencer of FIG. 1 in the viewing direction IV with the upper housing shell being omitted.
Figure 4:
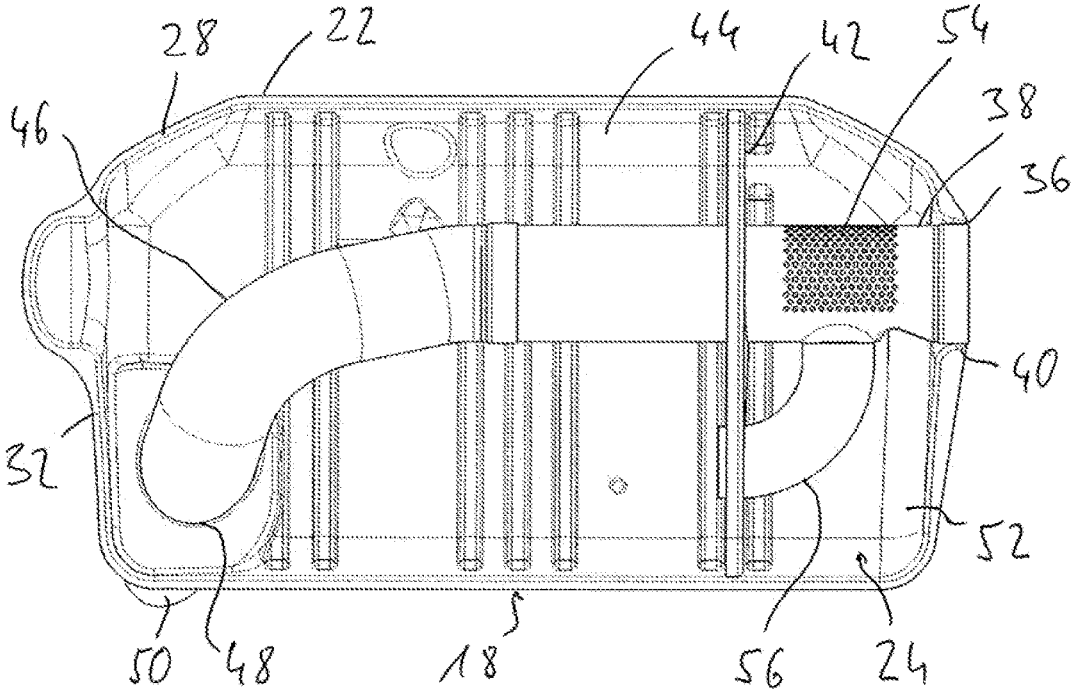

The housing opening 48 which is provided in association with the outlet pipe 46 is formed in the region of the circumferential wall 30 of the silencer housing 14. The silencer housing 14 is flattened transversely relative to the longitudinal housing axis L thereof and consequently provides substantially two wide sides 58, 60 shown at the top or bottom in FIG. 2 and two narrow sides 62, 64 which are shown on the right and left in FIG. 2.

The housing opening 48 through which the outlet pipe 46 extends is provided in the wide side 60 of the lower housing shell 22. In those regions in which the housing opening 48 is formed in the lower housing shell 22, the lower housing shell 22 is constructed in a substantially non-curved manner and thus has a region 66 which is located substantially in a plane E in which the housing opening 48 through which the outlet pipe 46 extends is formed. In the non-curved region 66 of the lower housing shell 22 which is located substantially in the plane E, the lower housing shell 22 is deformed in a region surrounding the housing opening 48 in a direction away from the silencer interior 24 in order to provide an end region 68 which preferably substantially completely surrounds the housing opening 48. The outlet pipe 46 adjoins the inner side of this edge region 68 so that a sharp-edged abutment contact is prevented. As a result of a weld seam which is, for example, guided along an outwardly orientated end face of the edge region 68, the outlet pipe 46 can be connected to the lower housing shell 22 in a secure and gas-tight manner.

Since the housing opening 48 is formed in the substantially non-curved region 66, which is located in the plane E, of the portion of the circumferential wall 30 which is provided on the lower housing shell 22, it can, for example, with a circular cross sectional contour of the outlet pipe 46 be provided in the longitudinal region 50 thereof which extends through the housing opening 48 in a comparatively simple geometric configuration, in particular with an elliptical circumferential contour, since the outlet pipe 46 is orientated in such a manner that the longitudinal region 50 thereof which extends through the housing opening 48 is orientated with the longitudinal center axis A thereof which is provided in this longitudinal region 50 in an angled manner with respect to an opening center axis M of the housing opening 48. In this instance, the opening center axis M is located substantially orthogonally with respect to the plane E in which the region 66, which has the housing opening 48, of the lower housing shell 22 is located.

In the structure of the silencer 10 illustrated in FIGS. 1 to 4, the outlet pipe 46, which may be constructed integrally or from a plurality of pipe segments, extends through the housing opening 48 and beyond the edge region 68. This longitudinal region 50 of the outlet pipe 46 is configured in an integral manner and provides an exhaust gas outlet opening 70 of the outlet pipe 46 or the silencer 10. Nonetheless, the outlet pipe 46 is configured with the longitudinal region 50 thereof which extends through and outside the housing opening 48 in such a manner that it substantially does not protrude over the entire outer circumferential contour of the silencer housing 14, in particular in a downward direction. Also in the direction of the longitudinal housing axis L, the outlet pipe 46 does not protrude over the outer circumferential contour of the silencer housing 14, which can be clearly seen in FIG. 4. Consequently, there is achieved a very compact construction of the silencer 10 which takes up little structural space in the region of an underbody of a vehicle and in which the comparatively large volume in the silencer interior 24 can nonetheless be used efficiently for sound insulation. Since the housing opening 48 through which the outlet pipe 46 extends is completely formed in one of the housing portions 16, 18, in particular the lower housing shell 22, in the region in which the outlet pipe 46 extends through this housing opening 48 and is connected to the housing portion 18, which provides this housing opening 48 by welding, only a connection between two components is achieved and can be produced in a comparatively simple manner with a high level of precision and consequently little waste during the production of such a silencer 10. Since the outlet pipe 46 with the longitudinal region 50 thereof which extends through the housing opening 48 and which also provides the exhaust gas outlet opening 70 protrudes outward only by a comparatively short extent over the silencer housing 14, there is no danger of end pipe shaking occurring as a result of vibrations present in a vehicle.

Finally, it should be noted that, without deviating from the principles of the present disclosure, the silencer illustrated in the figures could be configured differently in different regions. Thus, for example, two or more outlet pipes could be guided out of the silencer housing 14 in the manner illustrated in the figures in connection with the outlet pipe 46. Furthermore, for example, the housing opening 36 which is provided in association with the inlet pipe 38 could also be provided completely in one of the two housing shells 20, 22, preferably in the region of the circumferential wall.

It is understood that the foregoing description is that of the preferred embodiments of the invention and that various changes and modifications may be made thereto without departing from the spirit and scope of the invention as defined in the appended claims.

What is claimed is:

1. A silencer for an exhaust gas system of an internal combustion engine, the silencer comprising:

a silencer housing surrounding a silencer housing interior and including first and second housing portions, said silencer housing having a circumferential wall elongated in a direction of a longitudinal axis (L) and having first and second axial end regions, first and second end walls of said silencer housing being provided at said first and second axial end regions of said circumferential wall, respectively, said first and second housing portions conjointly defining an abutment region whereat said at least two housing portions are mutually adjacent, said first and second housing portions defining respective first and second housing shells mutually connected at said abutment region via at least one of material closure and positive locking engagement;

at least one outlet pipe extending through said silencer housing in the region of a housing opening;

wherein:

at least one housing opening through which an outlet pipe of said at least one outlet pipe extends is formed in said circumferential wall and is completely formed in one housing shell of said first and second housing portions;

said one housing shell has a substantially non-curved region located substantially in a plane (E) in said circumferential wall, said at least one housing opening being formed in said substantially non-curved region;

said at least one housing opening defines an opening center axis (M) located substantially orthogonally to said plane (E); and, said at least one outlet pipe defines a longitudinal center axis (A) and has a longitudinal region passing through said at least one housing opening so as to cause said longitudinal center axis (A) and opening center axis (M) to conjointly define an angle.

2. The silencer of claim 1, wherein said silencer housing is orthogonally flattened with respect to said longitudinal axis (L) to form a flattening; said at least one housing opening is formed in a predetermined region of said circumferential wall; and, said predetermined region defines a wide side of said silencer housing.

3. The silencer of claim 1, wherein said outlet pipe is configured so as not to protrude beyond said silencer housing in the direction of said longitudinal housing axis (L).

4. The silencer of claim 1, further comprising an edge region in the region of said at least one housing opening; and, said edge region surrounding said at least one housing opening and being shaped in a direction away from said silencer housing interior.

5. The silencer of claim 4, wherein said outlet pipe extends from said silencer housing interior to beyond said edge region surrounding said at least one housing opening.

6. The silencer of claim 4, wherein said outlet pipe terminates substantially flush with said edge region surrounding said at least one housing opening.

7. The silencer of claim 4, wherein said at least one outlet pipe is connected to said silencer housing in the region of said edge region by welding.

8. The silencer of claim 1, wherein said outlet pipe has a longitudinal region passing through said at least one housing opening and is constructed integrally with said longitudinal region thereof which extends in the region of said at least one housing opening and outside of said silencer housing interior and provides an exhaust gas outlet opening for discharging exhaust gas to the ambient.

9. An exhaust gas system for an internal combustion engine, the exhaust gas system comprising:

a silencer including:

a silencer housing surrounding a silencer housing interior and including first and second housing portions, said silencer housing having a circumferential wall elongated in a direction of a longitudinal axis (L) and having first and second axial end regions, first and second end walls of said silencer housing being provided at said first and second axial end regions of said circumferential wall, respectively, said first and second housing portions conjointly defining an abutment region whereat said at least two housing portions are mutually adjacent, said first and second housing portions defining respective first and second housing shells mutually connected at said abutment region via at least one of material closure and positive locking engagement;

at least one outlet pipe extending through said silencer housing in the region of a housing opening;

an inlet pipe extending through said silencer housing, an exhaust pipe guiding exhaust gas from the internal combustion engine being connected to said inlet pipe;

wherein:

at least one housing opening through which an outlet pipe of said at least one outlet pipe extends is formed in said circumferential wall and is completely formed in one housing shell of said first and second housing shells;

said one housing shell has a substantially non-curved region located substantially in a plane (E) in said circumferential wall, said at least one housing opening being formed in said substantially non-curved region;

said at least one housing opening defines an opening center axis (M) located substantially orthogonally to said plane (E); and, said at least one outlet pipe defines a longitudinal center axis (A) and has a longitudinal region passing through said at least one housing opening so as to cause said longitudinal center axis (A) and opening center axis (M) to conjointly define an angle.

10. The exhaust gas system of claim 9, wherein said silencer is an end silencer; and, said at least one outlet pipe has an exhaust gas discharge opening for discharging exhaust gas to the ambient.

* * * * *